US005137243A

United States Patent [19]

Stevens et al.

[11] Patent Number: 5,137,243

[45] Date of Patent: Aug. 11, 1992

[54] HOLDING DEVICE FOR A TAPERED SHAFT AND METHOD OF HOLDING A TAPERED SHAFT

[75] Inventors: Dan D. Stevens; Michael D. Stevens, both of Englewood; Lawrence E. Stevens, Littleton, all of Colo.

[73] Assignee: JDMS Corporation, Englewood, Colo.

[21] Appl. No.: 621,234

[22] Filed: Nov. 30, 1990

[51] Int. Cl.[5] ..... A47G 29/00

[52] U.S. Cl. ..... 248/316.7; 248/912

[58] Field of Search ..... 248/316.7, 231.8, 229, 248/911, 912, 74.2

[56] References Cited

U.S. PATENT DOCUMENTS

| | | | |
|---|---|---|---|
| 1,268,622 | 6/1918 | Reynolds | 248/316.7 X |
| 2,533,541 | 12/1950 | Warring | 280/53 |
| 2,860,679 | 11/1958 | Kouke | 150/1.5 |
| 2,985,462 | 5/1961 | Stamp | 280/47.19 |
| 3,056,412 | 10/1962 | Wolfe | 248/229 X |
| 3,164,185 | 1/1965 | Ingoldt | 150/1.5 |
| 3,216,687 | 11/1965 | Vardan | 248/229 |
| 3,521,332 | 7/1970 | Kramer | 248/229 X |
| 3,747,166 | 7/1973 | Eross | 248/229 X |
| 3,995,743 | 12/1976 | Blackburne | 211/65 |
| 4,112,550 | 9/1978 | DeWitt et al. | 248/231.8 X |
| 4,194,547 | 3/1980 | Sidor et al. | 150/1.5 |
| 4,616,749 | 10/1986 | Briggs | 206/315.2 |
| 4,934,644 | 6/1990 | Nagy et al. | 248/231 |

OTHER PUBLICATIONS

Sheet copied from catalog, Title: Golfsmith® 1990 Holiday Catalog.

*Primary Examiner*—David L. Talbott

*Attorney, Agent, or Firm*—Jean M. Macheledt

[57] ABSTRACT

A relatively rigid device for holding a circular cylindrical tapered shaft including a top and bottom end, a first and second outer side opposite each other, a third side opposite a fourth side, the first outer side having a channel extending along its length which abuts a tapered first bore, the second outer side having a channel extending along its length which abuts a tapered second bore, the tapered bores extending from the top end to the bottom end between the third and fourth sides, each of the third and fourth sides having an outer grip surface upon which force can be applied to firmly grip the device. Also, a method of holding a cylindrical tapered shaft including the steps of (a) providing a relatively rigid device with: a channel extending along a first outer side, the channel abutting a tapered bore, a solid volume portion in proximity to the tapered bore, both of which extend from the top end to the bottom end of the device between a third and fourth side, each of the third and fourth sides having an outer grip surface; (b) aligning an axis of the shaft to be generally parallel with an axis of the tapered bore; (c) moving the shaft through the channel into the tapered bore; (d) sliding the device relative to the shaft; and (e) applying force with a vise grip, brace, clamp, or other clamp-support apparatus to each of the outer grip surfaces.

12 Claims, 3 Drawing Sheets

HOLDING DEVICE FOR A TAPERED SHAFT AND METHOD OF HOLDING A TAPERED SHAFT

BACKGROUND OF THE INVENTION

In general, this invention relates to devices for supporting or holding malleable or fragile articles which must be firmly gripped for repair, rework, maintenance, building, or any other operation, to prevent the article from being bent, nicked, or otherwise harmed while the operation is performed. More particularly, this invention relates to: (a) a relatively rigid device for holding a cylindrical tapered shaft which can be used to prevent the shaft from being damaged while it is firmly gripped, or which can be used to detect a curvature in the shaft; and (b) a method of holding a cylindrical tapered shaft with such a device so that operations requiring the shaft to be firmly supported, can be performed.

Many articles have tapered shafts which can be damaged if gripped too firmly by a clamp-support apparatus or gripping means such as a vise grip, brace, or clamp. Golf clubs, bicycle frames, furniture, and some sporting racquets are just a few of the articles which have straight tapered tubular sections or shafts that are held in vise grips, braces, or clamps while the article is repaired, reworked, built, or otherwise operated upon. Instruments and attachments for holding the shafts of articles are shown in U.S. Pat. Nos. 2,533,541 issued to A. Warring; 4,616,749 issued to Briggs; 2,985,462 issued to H. O. Stamp; and 3,995,743 issued to Blackburne. There exists a resilient golf club shaft gripping tool, solely made of a rubber compound, which has a single untapered right circular cylindrical hole through it and two slits. One of the slits cuts through the tool from the hole to an outside wall and the other slit is located diagonally across the hole from the first slit. The slits act to allow the tool to be pried apart so that a shaft can be pressed into the hole. The tool was designed to be used as a gripping instrument. However, applying pressure to the tool by a clamp-support apparatus will cause the tool to deform, possibly damaging the shaft held within.

None of the known instruments, attachments, or tools are designed (a) to be gripped by a clamp-support apparatus or (b) to prevent a tapered tube or shaft from being damaged if firmly gripped by a clamp-support apparatus. None of these known instruments, attachments, or tools can adequately prevent a tapered tube or shaft from being damaged if firmly gripped by a clamp-support apparatus. Since this is so, many maintenance operations must either be done professionally by a shop having the proper equipment or done by hand. For example, if the owner of a set of golf clubs wants to replace a golf club handgrip, it is generally done by hand to ensure that the club shafts are not damaged. Replacing handgrips by hand is a difficult and tedious task. There is, thus, a need for a device which will allow a tapered shaft to be gripped by a clamp-support apparatus without damaging the shaft; and furthermore, there is a particular need for a simple device that will allow a tapered golf club shaft to be held in a clamp-support apparatus while its handgrip is replaced.

SUMMARY OF THE INVENTION

It is a primary object of this invention to provide a relatively rigid device for holding a cylindrical tapered shaft, that will prevent the shaft from being damaged if gripped by a clamp-support apparatus or gripping means. It is a further object to provide a method of holding a cylindrical tapered shaft with such a device.

The advantages of providing a device and method as described herein are: (a) cylindrical tapered shafts can now be supported or held in place by an apparatus capable of producing a firm grip, without damaging the shaft; and (b) by using the device, a person can more easily perform certain operations on articles which have a malleable or fragile tapered shaft, without having to use expensive equipment specially designed for holding the articles.

Briefly described, the invention includes a relatively rigid device having a top and bottom end, a first and second outer side opposite each other, and a third side opposite a fourth side. The first outer side has a channel extending along its length which abuts a tapered first bore, and the second outer side has a channel extending along its length which abuts a tapered second bore. The tapered bores extend from the top end to the bottom end between the third and fourth sides. Each of the third and fourth sides has an outer grip surface upon which force can be applied to firmly grip the device. Each tapered bore can have a different inner diameter to accommodate a wider range of shaft sizes. The tapered bores can be oriented so that their larger diameters are located at the same end of the device or at different ends of the device.

Another characterization of the invention is a method of holding a cylindrical tapered shaft including the steps of (a) providing a relatively rigid device with the following characteristics: a channel extending along a first outer side, the channel abutting a tapered bore, a solid volume portion in proximity to the tapered bore, the tapered bore and volume portion extending from the top end to the bottom end of the device between a third and fourth side, each of the third and fourth sides having an outer grip surface; (b) aligning an axis of the shaft to be generally parallel with an axis of the tapered bore; (c) moving the shaft through the channel into the tapered bore; (d) sliding the device relative to the shaft until an outer surface of the shaft meets an inner surface of the bore; and (e) applying force with a gripping means to each of the outer grip surfaces.

BRIEF DESCRIPTION OF THE DRAWINGS

The invention will be more particularly described by referencing the accompanying drawings of the preferred embodiments, in which like numerals designate like parts.

DETAILED DESCRIPTION OF THE PREFERRED EMBODIMENTS

Figure 1:
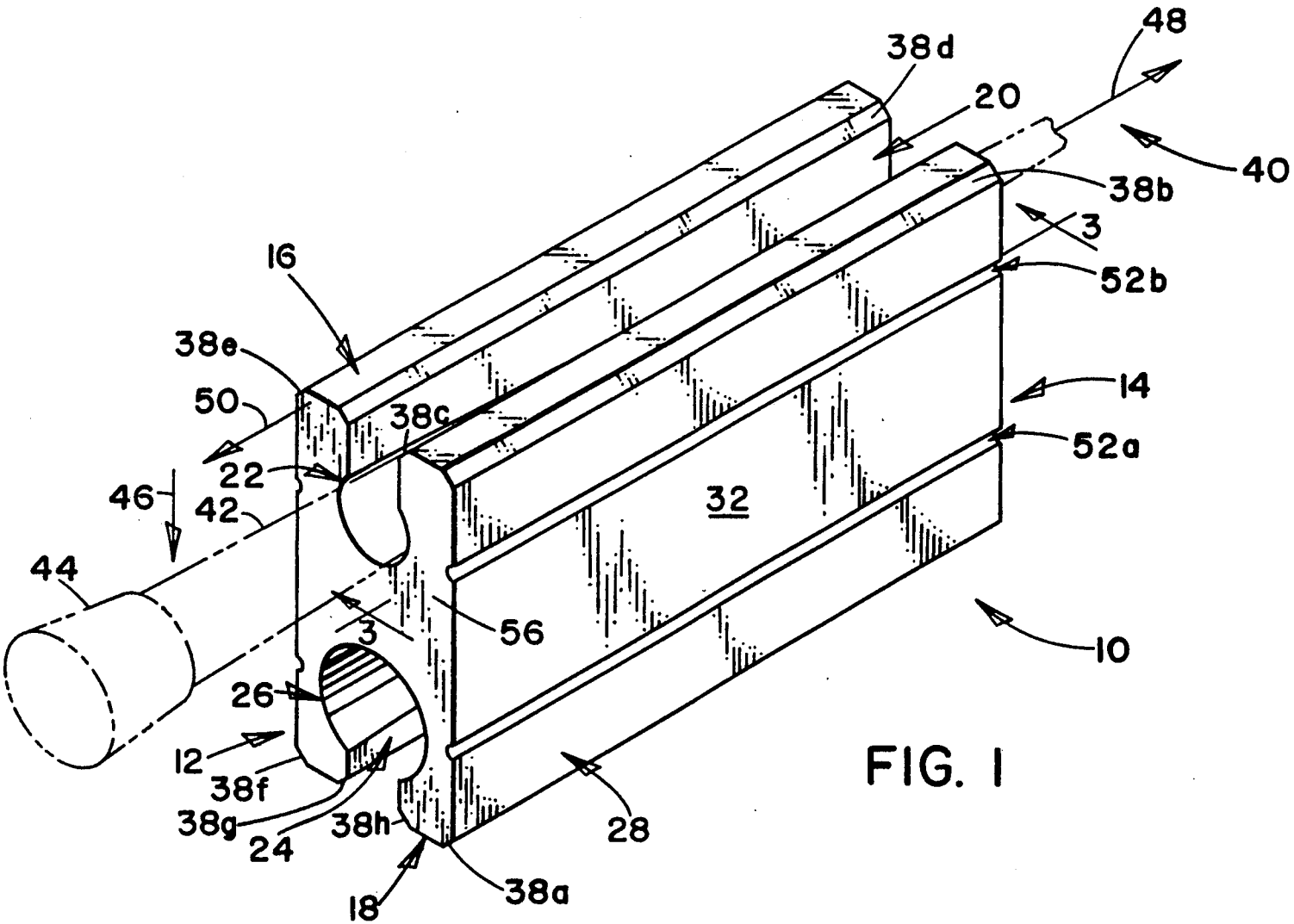
FIG. 1 is an isometric view of a preferred device of the invention illustrating in part (in phantom), a shaft placed into the top bore of the device.

Shown at 10 of FIG. 1 is a preferred device of the invention having outer sides 16, 18, side 28 (side 30, which is opposite side 28, is not in view), a top end 12, and a bottom end 14. A channel 20 extends along the length of side 16 to allow the smaller end of a tapered shaft 42 (shown in phantom) to be moved in a general direction indicated by arrow 46 and placed into tapered bore 22. Another channel 24 extends along the length of side 18 to allow the smaller end of a tapered shaft such as the one shown at 42 to be placed into tapered bore 26. Channels 20, 24 need not be tapered but must each have a width, labelled w1 and w2 in FIG. 4, sufficient to allow at least some portion of a shaft to fit through the channels. Shaft 42 has been broken at its smaller end, shown at 40. This is the end that would contain the wood or iron head of a golf club. As can be understood, most articles with tapered shafts will have projections, knobs, handles, etc. at each end of the shaft so that a channel 20, 24 must be added to allow the shaft to be placed into one of the tapered bores 22, 26.

A solid volume portion 56 is located between tapered bores 22 and 26. Side 28 has an outer grip surface 32 upon which force can be applied by a clamp-support apparatus or gripping means such as a vise grip, brace, or clamp mechanism (see, for example, the bench vise grip shown at 158 in FIG. 6). The structure, operation, and use of such clamp-support apparatuses or gripping means are well known. Additionally, side 28 can include markings 52*a*, 52*b* useful for orienting device 10 in a clamp-support apparatus or gripping means to ensure that the vise or clamp jaws are positioned over solid volume portion 56. Proper positioning of the vise, brace, or clamp jaws over volume portion 56 is especially important if the sidewalls of channels 20, 24 are thin. Firmly gripping the device over the channel sidewalls, if too thin, may result in damage to a shaft positioned in a tapered bore. Markings 52*a*, 52*b* can be replaced with other suitable device-orienting indicia. Chamfers 38*a*, 38*b*, 38*c*, 38*d*, 38*e*, 38*f*, 38*g*, 38*h* have been added to take the edges of the device off, making the device easier to handle.

The tapers of shaft 42 and bore 22 must be oriented in the same direction to allow shaft 42 to be slid relative to device 10 to position the outer surface of shaft 42 against the inner surface of bore 22. This will hold the shaft in place within the device. The relative movement or sliding of shaft 10 42 with respect to device 10 can be accomplished by either moving shaft 42 along direction arrow 48 or moving the device 10 along direction arrow 50. Once a golf club shaft, for example, is in position against the inner surface of bore 22, the old handgrip can be removed by slitting it with a razor blade or other sharp object and peeling it away from the larger end of the shaft. A new handgrip can now be pushed-on over the larger end. The taper orientation of bore 22 allows a "self-tightening action" to take place between the outer surface of shaft 42 and the inner surface of bore 22 when force is applied to push-on the new handgrip. This aids in supporting the shaft 42 within device 10.

Figure 2:
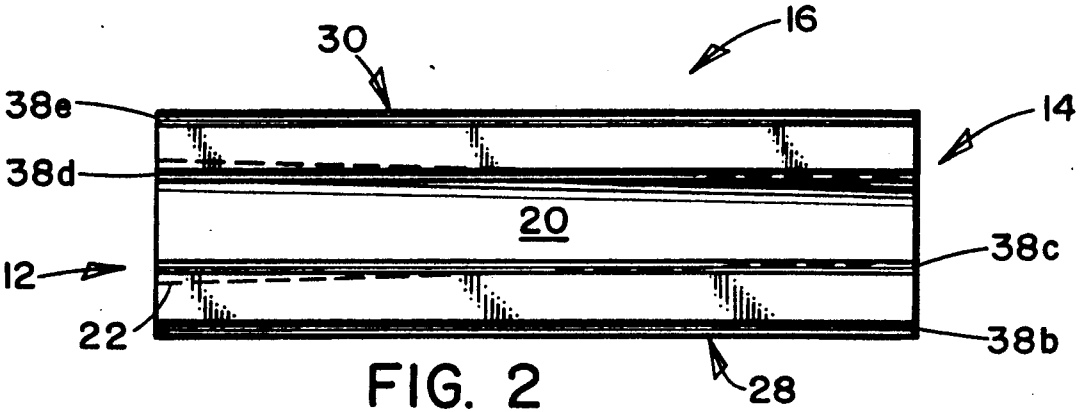
FIG. 2 is a side elevational view of the device shown in FIG. 1.

The outer side 16 view in FIG. 2, illustrates bore 22 (shown in hidden lines to extend from top end 12 to bottom end 14), sandwiched between sides 28, 30. Chamfers 38*b*, 38*c*, 38*d*, 38*e* can be seen.

Figure 3:
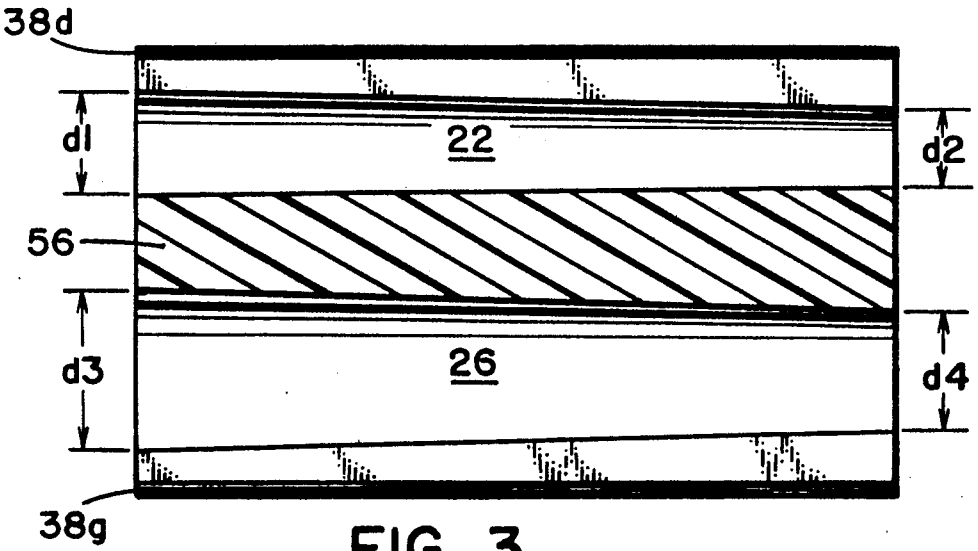
FIG. 3 is a sectional view taken along 3—3 of FIG. 1.

Turning to FIG. 3, bore 22 is illustrated with an inner diameter d1 greater than inner diameter d2. Bore 26 has an inner diameter d3 greater than inner diameter d4. Bore 26 is shown to have an overall inner diameter that is greater than that for bore 22. Solid volume portion 56 is cross-hatched and chamfers 38*d*, 38*g* can be seen. The device is preferably made of any relatively rigid or stiff material such as: a polymeric (thermoplastic) resin known as type KR03 K-RESIN ® manufactured by the Phillips Petroleum Company; a nylon such as TRIAX II ® (for example, the 1100 or 1120 Series of melt flow grades) manufactured by Monsanto Chemical Company; an acetal resin/polyacetal, which are synthetic resins produced by the polymerization of acetal homopolymers or acetal copolymers, such as DELRIN ® (general purpose 500 Series) manufactured by E.I. du Pont de Nemours & Co.; wood; or a polypropylene compound having an amount of an elastomer such as synthetic rubber or KRATON ® material manufactured by Shell Oil (the component amounts of the compound determined according to desired hardness/stiffness). K-RESIN ® is a registered trademark of the Phillips Petroleum Company, TRIAX II ® is a registered trademark of the Monsanto Chemical Company, DELRIN ® is a registered trademark of the E.I. du Pont de Nemours & Co., and KRATON ® is a registered trademark of the Shell Oil Corporation. It is preferred that the material used for device 10 be one that does not exhibit a great amount of elasticity.

The device can be machined or carved from a solid piece or injection molded using known techniques. Injection molding consists of feeding a plastic compound in powdered or granular form from a hopper through metering and melting stages and then injecting it into a mold. After a brief cooling period, the mold is opened and the solidified part ejected. Many well known methods and machines are used to inject the melted plastic into a mold such as an in-line reciprocating screw machine.

Figure 4:
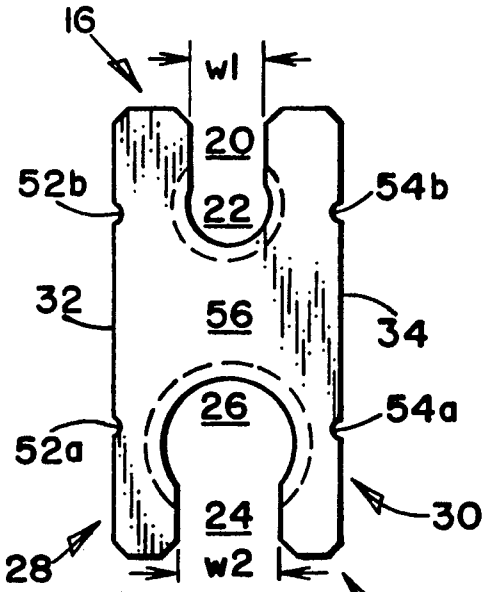
FIG. 4 is a bottom end plan view of the device shown in FIG. 1.

The bottom end view of FIG. 4 illustrates: outer sides 16, 18; side 28 with markings 52*a*, 52*b* and outer grip surface 32; and side 30 with markings 54*a*, 54*b* and outer grip surface 34. Solid volume portion 56 preferably extends substantially from side 28 to side 30 to provide adequate support so that the device is not greatly deformed when gripped by a clamp-support apparatus or gripping means. The width of channel 20 is shown as w1 and the width of channel 24 is shown as w2. Hidden lines indicate the larger inner diameters of bores 22, 26.

Figure 5:
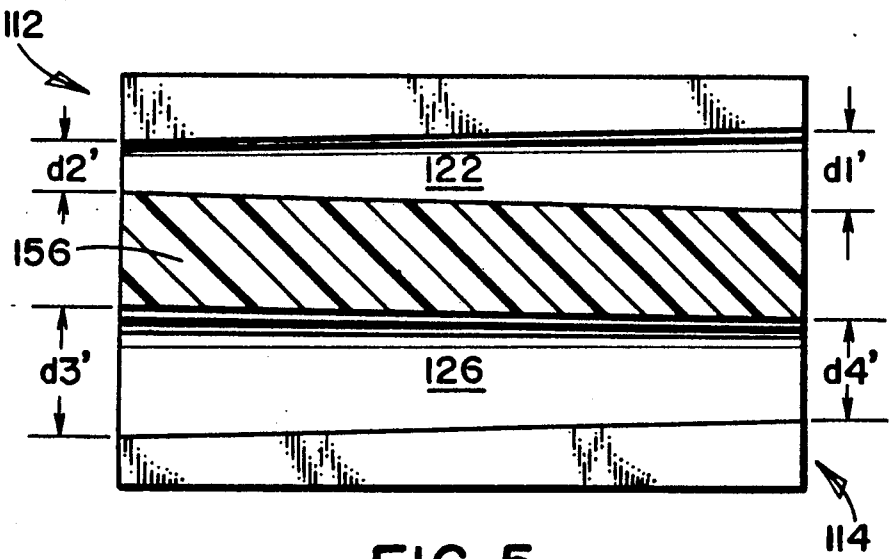
FIG. 5 is a sectional view similar to that of FIG. 3, illustrating an alternative device of the invention.

The alternative embodiment in FIG. 5 illustrates a bore 122 with an inner diameter d1' at bottom end 114 which is greater than inner diameter d2' at top end 112. Bore 126 has an inner diameter d3' at top end 112 which is greater than diameter greater than that of bore 122.

Figure 6:
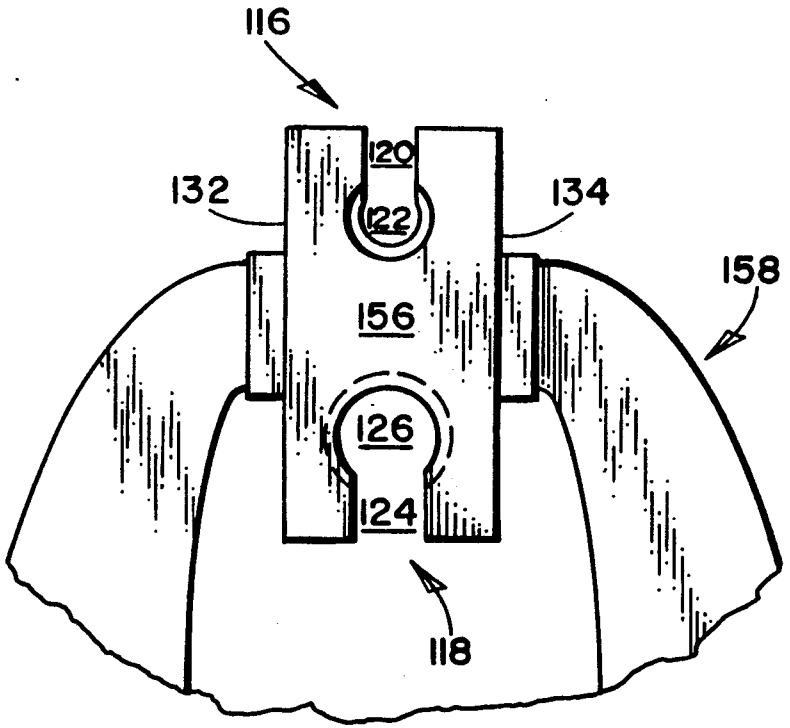
FIG. 6 is a bottom end plan view similar to that of FIG. 4, illustrating the bottom end of the FIG. 5 alternative device being gripped by a clamp-support apparatus or gripping means.

Turning to FIG. 6, outer side 116 has a channel 120 abutting bore 122 and outer side 118 has a channel 124 abutting bore 126. Solid volume portion 156 is located between bores 122, 126. Gripping means 158 such as a vise grip, brace, or clamp mechanism, applies force to outer grip surfaces 132, 134. As set forth above, a wide variety of known gripping means may be useful to support the device while a shaft is being held within.

The device can alternatively be made long enough so that it can be used to detect curvature in a shaft. In this capacity, the device is a measuring tool.

By way of example only, a device was machined out of a piece of DELRIN ® 500 Series plastic to produce a device similar to that shown in FIG. 1 with a length of approximately 3.04 inches, a height of approximately 1.65 inches, and a width of approximately 1.02 inches.

The smaller bore 22 has a smaller inner diameter of 0.358 inches at the bottom end and a larger inner diameter of 0.388 inches at the top end. The larger bore 26 has a smaller inner diameter of 0.419 inches at the bottom end and a larger inner diameter of 0.447 inches at the top end. These bore dimensions result in tapers angled from about 0.3 degrees to 0.5 degrees, plus-or-minus 0.05 degrees. Channel 20 has a width w1 of 0.343 inches and channel 24 has a width w2 of 0.390 inches. This example device accommodated golf club shafts for most woods and irons.

While certain representative embodiments and details have been shown for the purpose of illustrating the invention, it will be apparent to those skilled in this art that various modifications may be made to the invention without departing from the spirit or scope of the invention.

What is claimed is:

1. A substantially rigid device for holding a circular cylindrical tapered shaft, comprising:

a top and bottom end;

a first and second outer side opposite each other, said first outer side having a first channel extending along its length, said first channel abutting a tapered first bore, said second outer side having a second channel extending along its length, said second channel abutting a tapered second bore;

a third side opposite a fourth side each having a substantially planar outer grip surface; and said first and second bores each extending from said top end to said bottom end between said third and fourth sides.

2. The device of claim 1 wherein an inner diameter of said tapered first bore at said bottom end is greater than an inner diameter thereof at said top end, and an inner diameter of said tapered second bore at said top end is greater than an inner diameter thereof at said bottom end.

3. The device of claim 2 wherein:

said inner diameter of said tapered second bore at said top end is greater than said inner diameter of said tapered first bore at said bottom end;

said inner diameter of said tapered second bore at said bottom end is greater than said inner diameter of said tapered first bore at said top end; and said second channel has a width greater than that of said first channel.

4. The device of claim 3 wherein the device is made of a material selected from the group consisting of polymeric resin, thermoplastic, nylon, wood, or a polypropylene compound.

5. The device of claim 1 wherein an inner diameter of said tapered first bore at said top end is greater than an inner diameter thereof at said bottom end, and an inner diameter of said tapered second bore at said top end is greater than an inner diameter thereof at said bottom end.

6. The device of claim 5 wherein:

said inner diameter of said tapered second bore at said top end is greater than said inner diameter of said tapered first bore at said top end;

said inner diameter of said tapered second bore at said bottom end is greater than said inner diameter of said tapered first bore at said bottom end; and said second channel has a width greater than that of said first channel.

7. The device of claim 6 wherein the circular cylindrical tapered shaft is a golf club shaft.

8. The device of claim 5 wherein an axis of said tapered first bore is substantially parallel to an axis of said tapered second bore.

9. The device of claim 5 further comprising a solid volume portion between said tapered first and second bores extending substantially from said third side to said fourth side.

10. The device of claim 5 wherein each of said third and fourth side further comprises indicia for orienting the device when used with a gripping means, said indicia comprising at least two substantially parallel markings extending at least partially between said top and bottom ends.

11. The device of claim 5 wherein the device is made of a material selected from the group consisting of polymeric resin, thermoplastic, nylon, wood, or a polypropylene compound.

12. A substantially rigid device for holding a golf club shaft while it is firmly gripped, comprising:

a top and bottom end;

a first and second outer side opposite each other, said first outer side having a first channel extending along its length, said first channel abutting a tapered first bore, said second outer side having a second channel extending along its length, said second channel abutting a tapered second bore;

a third side opposite a fourth side each having an outer grip surface;

said first and second bores each extending from said top end to said bottom end between said third and fourth sides;

a solid volume portion between said first and second bores extending substantially from said third side to said fourth side; and an inner diameter of said first bore at said bottom end being greater than an inner diameter thereof at said top end, and an inner diameter of said second bore at said top end being greater than an inner diameter thereof at said bottom end.

* * * * *